US008307900B2

(12) United States Patent
Lynde et al.

(10) Patent No.: US 8,307,900 B2
(45) Date of Patent: Nov. 13, 2012

(54) METHOD AND APPARATUS FOR PERFORMING LASER OPERATIONS DOWNHOLE

(75) Inventors: Gerald D. Lynde, Houston, TX (US); Joseph P. DeGeare, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 52 days.

(21) Appl. No.: 11/621,878

(22) Filed: Jan. 10, 2007

(65) Prior Publication Data

US 2008/0166132 A1 Jul. 10, 2008

(51) Int. Cl.
*E21B 29/00* (2006.01)
*E21B 43/00* (2006.01)

(52) U.S. Cl. ..... 166/297; 166/376; 166/126

(58) Field of Classification Search ..... 166/297, 166/376, 126, 129, 142; 175/11, 16; 385/12, 385/13, 14, 37, 31, 88, 89, 82, 128; 367/25, 367/64, 69, 80
See application file for complete search history.

(56) References Cited

U.S. PATENT DOCUMENTS 2,927,644 A * 3/1960 Caldwell ..... 166/99
3,977,478 A * 8/1976 Shuck ..... 175/16
4,199,034 A * 4/1980 Salisbury et al. ..... 175/11
6,021,377 A 2/2000 Dubinsky et al.
6,041,860 A 3/2000 Nazzal et al.
6,155,343 A 12/2000 Nazzal et al.
6,275,645 B1 * 8/2001 Vereecken et al. ..... 385/147
6,880,646 B2 * 4/2005 Batarseh ..... 175/15
6,888,097 B2 5/2005 Batarseh
2004/0206505 A1 10/2004 Batarseh
2004/0256103 A1 12/2004 Batarseh
2006/0102343 A1 * 5/2006 Skinner et al. ..... 166/250.1
2007/0242265 A1 * 10/2007 Vessereau et al. ..... 356/241.1

* cited by examiner

*Primary Examiner* — Brad Harcourt
(74) *Attorney, Agent, or Firm* — Mossman, Kumar & Tyler, PC

(57) ABSTRACT

The disclosure, in on aspect, provides a method for performing a laser operation in a wellbore that includes displacing a wellbore fluid with a laser-compatible medium proximate a location in the wellbore where a work is desired to be performed; positioning a laser head proximate the laser-compatible medium; and passing a laser beam via the laser-compatible medium to the location for performing the laser operation. In another aspect, the disclosure provides a laser apparatus for performing a laser operation at a worksite having a fluid that includes a laser power unit that supplies laser energy to a laser head placed proximate the worksite; a fluid displacement unit that displaces at least a portion of the fluid adjacent the worksite with a laser-compatible medium; and a controller that operates the laser head to pass the laser beam to the worksite through the laser-compatible medium. In another aspect, the disclosure provides an imager associated with the laser apparatus that provides images of the worksite.

25 Claims, 2 Drawing Sheets

METHOD AND APPARATUS FOR PERFORMING LASER OPERATIONS DOWNHOLE

BACKGROUND OF THE DISCLOSURE

1. Field of the Disclosure

This disclosure relates to apparatus and method for performing operations downhole using a laser.

2. Background of the Art

In the oil and gas industry much attention has been given to apparatus and methods to remove undesired materials downhole, including both materials inherent in a formation and also both natural and man-made materials which have been introduced into a formation for purposes of extracting the natural resources, such as oil and gas, from the subsurface formations. Examples include drilling of the initial wellbores; perforation of the formation to initiate or increase productive flow therefrom; modification of wells such as casing removal for drilling laterals, remediation of casings, elimination of equipment occlusion, and the like; and elimination of debris, scale, and other impediments to the productive flow of fluids in the wellbores.

It is known in the art to use lasers for certain type of downhole cutting operations. However, it is generally held that much use of laser cutting in downhole environments remains difficult because of the presence of fluids and other materials in the wellbore, such as drilling fluid (also referred to as the "mud"), production fluids and other materials that may have been added into the wellbore to facilitate drilling and or to extract fluids from the formation. Such fluids and materials are generally opaque, near-opaque or very dark and are not conducive to laser operations. Therefore, there is a need for an improved method and apparatus for performing laser operations downhole.

SUMMARY OF THE DISCLOSURE

The present disclosure includes both a method and an apparatus that make use of lasers for downhole applications. The disclosure, in one aspect, provides a method for performing a laser operation in a wellbore that includes displacing a wellbore fluid with a laser-compatible medium proximate to a location in the wellbore where work is to be performed; positioning a laser head proximate the laser-compatible medium; and passing a laser beam via the laser-compatible medium to the desired location for performing the laser operation. In another aspect, the disclosure provides a laser apparatus for performing a laser operation at a worksite having a fluid that includes a laser power unit that supplies laser energy to a laser head placed proximate the worksite; a fluid displacement unit that displaces at least a portion of the fluid adjacent the worksite with a laser-compatible medium; and a controller that operates the laser head to pass the laser beam to the worksite through the laser-compatible medium. In another aspect, the disclosure provides an imager associated with the laser apparatus that provides images of the worksite and the operations carried out by the laser apparatus.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto

BRIEF DESCRIPTION OF THE DRAWINGS

For a detailed understanding of the various aspects of the disclosure herein, reference should be made to the following detailed description of the preferred embodiment, taken in conjunction with the accompanying drawings, in general in which like elements have been given like numerals, wherein.

DETAILED DESCRIPTION OF THE DRAWINGS

Figures 1, 4:
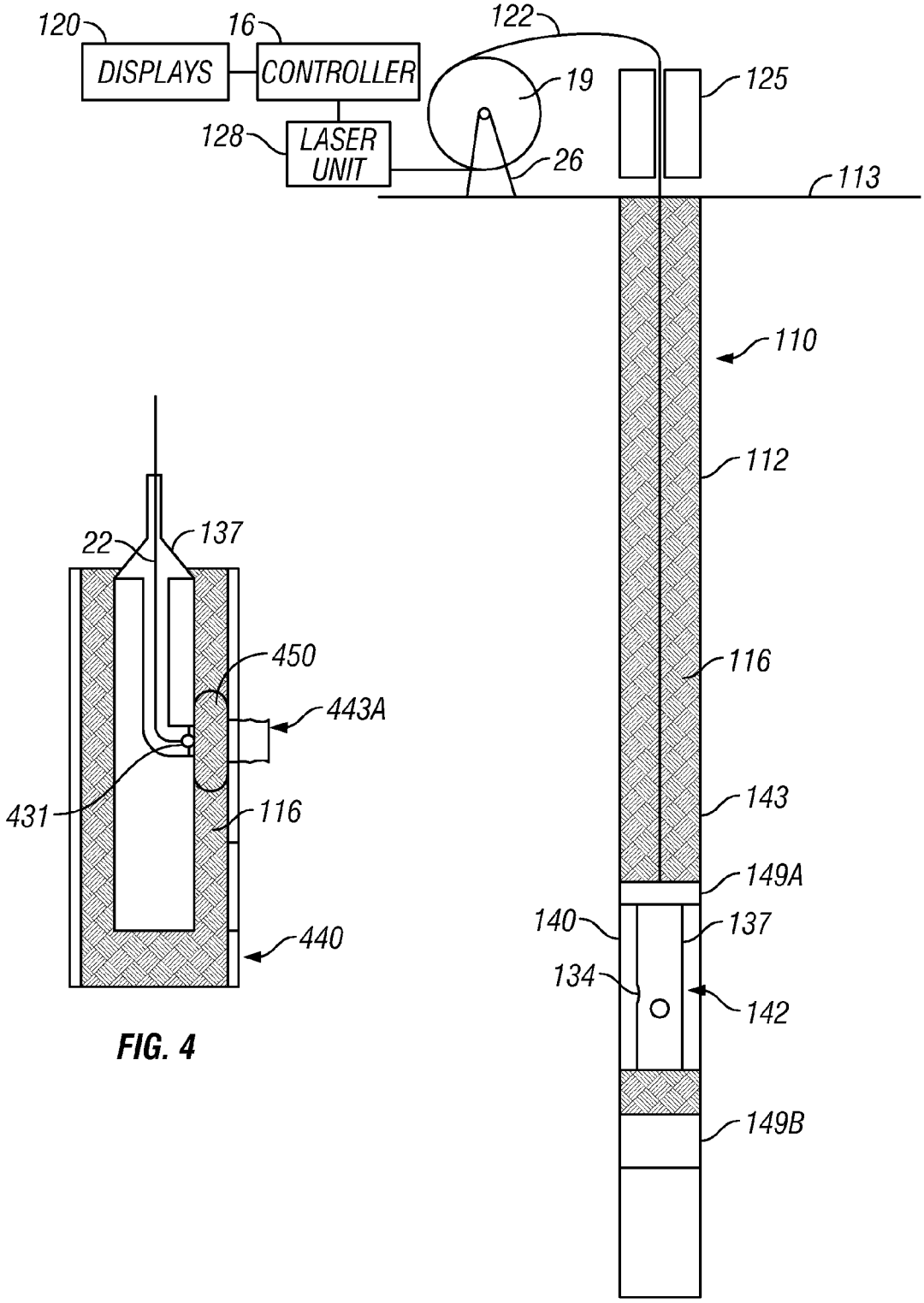
FIG. 1 is a schematic drawing showing a laser apparatus placed in the wellbore in a section of a wellbore where the wellbore fluid has been displaced with a laser-compatible medium for performing a downhole operation, according to one exemplary embodiment.
FIG. 4 is a schematic drawing showing a laser apparatus placed in a section of the wellbore wherein a flexible member or compliant member that includes a laser-compatible medium has been deployed to displace a portion of the wellbore fluid, according to another exemplary embodiment.

The disclosure in one aspect provides apparatus and method for performing laser operations downhole. The apparatus and methods herein described may be useful when a reduction of the laser energy can occur when the light from a laser source travels downhole, or any significant distance, and when translucent and/or near-opaque media are interposed between the location of laser beam emission and the object or location at which a laser operation is to be performed. In one aspect, to enable the laser beam in the wellbore to effectively impinge onto the object, the wellbore fluid between the object and a laser head is displaced or replaced with a laser-compatible medium (also referred to herein as a "laser-friendly" medium), such as a relatively clear fluid or material.

In one aspect, the disclosure provides for displacing a portion of the wellbore fluid, such as a production fluid, which may be hydrocarbons or combinations of hydrocarbons with water and/or natural gas, drilling fluids, such as drilling muds, and the like, with a laser-compatible medium, such as a relatively clear fluid. As used herein, the term "relatively clear" or "laser-compatible" or "laser-friendly" material or medium refers to a medium that is transparent to an extent greater than the fluid(s) being displaced. Also, the term "medium" means either a fluid, which may be a gas, such as argon, or air, or liquid, or a gel or a combination of such materials or a flexible membrane which may or may not be filled with another medium, or any other medium through which the laser beam can effectively pass to perform an intended operation downhole.

To displace the wellbore fluid from a section of the well, the disclosure in one non-limiting embodiment, provides for pumping a medium that is relatively clear to laser beams into the well proximate a location where a laser operation is to be effected, in an amount that is sufficient to fill the space between the laser beam emission point or end (also herein termed the "laser cutter head" or the "laser head") and the object, such as a material being cut, e.g., part of a casing. Often, the area of laser operation may be from a few to several meters (such as 2-10 meters) of the well length, but larger or smaller well areas may also be selected depending upon the size of the object or the area on which the desired laser operation is to be performed. In one aspect, as the laser-compatible medium is placed or pumped into the selected location, the wellbore fluids normally present at that location are simultaneously moved or pumped out of the location, thereby enabling the laser-compatible medium to displace a portion of the wellbore fluids. To obtain isolation of the laser-compatible medium from the wellbore fluids and/or to prevent leakage of the wellbore fluid into the selected area or region, a packer on one side (such as uphole) of the location, or a packer on either side (uphole and downhole) of the selected area may be placed before pumping in the laser-compatible fluid. Any suitable packer, including traditional packers, such as inflatable packers and packing methods may be employed. The laser-compatible medium may be pumped from a surface location via a tubing conveyed into the wellbore or by using a pump associated with a fluid chamber deployed in the wellbore to pump the laser-compatible fluid into the selected region.

In another aspect, a hard or soft lens or an inflatable member or fluid filled flexible member, such as a sac, bag, or other compliant member, allowing delineation of the relatively clear medium from the wellbore fluid, may be interposed between the laser head and the object. For example, a flexible plastic sac filled with a fluid, gel, air, or gas (such as argon), a lens, etc. may be placed at a location such that the laser beam passes from the laser head, through the medium and onto the object, without passing through any additional regions comprising other media that are not laser compatible. Such a lens, sac or similar members may be connected with, or placed within, or made integral to the laser head or a laser protective housing, or they may be inserted into the well and positioned independently of the laser head.

In a non-limiting embodiment, the fluid or gel may be air; other transparent gas (such as argon); water; relatively low density clear liquids, such as glycerine, alcohols, glycols, diols and the like; polymers; and combinations thereof. The use of gels could be beneficial in that such gels could be formed with an integral "skin," without the need for a separate sac and fillings. Such gels could be designed to employ materials having particularly optimized optical properties, allowing for minimization of distortion and/or reflectance of the laser beam or, in some embodiments, for improved focusing thereof. The laser may utilize a lens or an equivalent structure that is compatible for downhole use.

The laser head used according to the configurations herein can function with a lower loss or disruption of the laser beam as to both direction and intensity and thus may enable improved efficacy of the laser operation, such as a cutting of a material downhole. Such configurations also provide the potential to include an imaging device (also referred to herein as an "imager"). The imaging device may be integrated into a common housing with the laser head or it may be placed proximate or in the same region as that of the laser head and/or the space between the laser head and the object. Because of the removal of the translucent or opaque fluids from the space between the laser head and the object, the imaging device can provide real-time view or images of the downhole environment, including the images of the downhole object and the laser operation being performed. Such imaging devices or imagers may include, but are not limited to, an on-board video camera, an acoustic imaging device or any other suitable device that can provide visual images of the object or location. The imaging device is adapted for downhole use (temperature, pressure and vibration) and may be mounted with or within the laser head's housing. In some embodiments, the imaging device may be located with or within a laser-compatible medium, such as a lens or a fluid-filled or gel-filled sac, "bubble," gas, or the like. In alternative embodiments, the imaging device may be independently introduced into and positioned in the well adjacent to the selected site. In general, reducing the number of media through which the image is obtained tends to reduce distortion and interference and increases the overall definition or the quality of the image. This may in turn increase the precision with which the laser operation may be accomplished.

In one embodiment, the laser apparatus, the imaging apparatus, or a combination thereof may include a controller or control system to provide control of the imaging device and the laser. The controller or control system may include a processor and associated memory and circuitry to manipulate mechanisms associated with the laser head to position the laser beam relative to the object on which the laser operation is to be performed; movement and stability of the laser head during and after the laser operation; movement, operation and stability of the imaging device; initiation, promulgation, pulsation, intensity control and intensity variation of the laser beam emissions; and the like. Feedback and sensing circuits may be provided, which may include measurements generated at or near the laser head, the imaging device, or both, which are of use to the operator at the surface in determining the course of action and progress of the laser operation. For these purposes, appropriate electrical devices and circuits, computer, memory devices, data input devices, visual display devices, other peripherals and other linkages and connections may be used, which are within the understanding and design capabilities of those in the art and may be included or incorporated in either the practice of the methods or the design and use of the apparatus made according to the various aspects of the disclosure.

In employing the methods and/or the apparatus of the disclosure, the laser source is generally energized to provide an appropriate light output that is transmitted from the source, which in one aspect, may be located at the surface, to the laser input end and then to the laser output end at the laser head via a fiber optic cable. The fiber optic cable may run inside a coiled tubing that is used to deploy the laser apparatus into the wellbore. The laser output end communicates with the laser head, which includes a tip at the laser output end from which the laser beam is emitted in a directional manner. The laser beam is directed toward the object on which a laser operation is to be performed, such as cutting operation, which may be, for example in one non-limiting embodiment, an inner casing surface at which a window is to be cut to enable drilling and eventual completion of a lateral wellbore. Identification of the location of the laser head relative to the object may be enhanced by use of an imaging device. The laser beam is emitted into and through either a relatively clear fluid that has been placed in the applicable well section or region, or into and through a lens or a fluid-filled or gel-filled member that is configured or positioned between the laser head and the object.

The laser beam in some embodiments is controlled from surface as to its intensity, pulse rate, etc. as well as its location of contact with the object to perform the intended operation, such as to melt or vaporize the material. In embodiments where the material to be cut is a well casing, the laser cutter apparatus may be used stepwise, to cut first a metal tubular casing and then an annular concrete structure behind it, eventually reaching the formation. In alternative embodiments with sufficient intensity of the laser beam, the metal and concrete structures may be cut simultaneously. Thereafter, the formation may be cut using the laser head instead of a drill, or the laser cutter head may be removed from the well and more conventional drilling method employed to drill a lateral wellbore. Following an appropriate cut, the laser head may also be employed to remove burring around the cut area, to vaporize cutting debris, and the like. In other embodiments, the laser head may be employed for perforation and remediation of various kinds in order to optimize production fluid flow. The laser herein also may also be utilized to energize a location in the wellbore to build scalp; remove scale, apply localized heat to an element downhole, bond a material, remove waxes and other accumulates.

In another aspect, the laser may be utilized to activate a memory metal downhole, activate a heat sensitive polymer, activate a heat sensitive chemical agent or another heat sensitive carrier. The laser also may be used to weld or bond a metallic piece or member to another metallic member.

FIG. 1 is a schematic diagram showing an embodiment of a system 100 including a laser apparatus for use in a wellbore 110 that is lined with a casing 112 having a wellbore fluid 116 therein. The system 100 includes a surface laser source unit 128 for supplying or pumping laser energy to a downhole laser unit 137 that includes a laser head or a laser cutting head 134. In the embodiment of FIG. 1, an isolation member, such as a packer 149A, is placed above the downhole laser unit 137 to isolate a desired section 142 (also referred to herein as the worksite) of the wellbore 110) adjacent the laser head 134. A secondary packer 149B may be placed below the downhole laser unit 137 to completely isolate the wellbore fluid in the section 142 between the packers 149*a* and 149*b*. In FIG. 1 the wellbore fluid 116 in the isolated section or zone 142 is shown replaced with a laser-compatible fluid 140, such as a clear fluid. In operation, the downhole laser unit 137 may be deployed or located at the desired wellbore depth by any suitable conveying member, including a coiled tubing 122 carried on a spool 119 and injected into the wellbore 110 by an injector head 125 located at the surface 113. Optical fibers 125 carrying the laser energy or light beam from the laser source unit 128 may be run to the downhole laser unit 137 inside the coiled tubing 122. The optical fibers 125 may be placed in protective tubing (not shown) that runs along the inside of the coiled tubing or attached inside and along the length of the coiled tubing 122. A controller, such as the surface controller 160, may be utilized to control the operation of the laser unit 128. The controller 160 may include a computer or processor, memory for storing data and computer programs that are executed by the processor, to control the operation of the surface laser unit 128 and the downhole laser unit 137 as explained in more detail in reference to FIGS. 2-5. A display unit 120 may be provided for displaying a variety of information relating to the laser operation downhole, including visual images of the operations being performed by the laser unit 137. The display unit 120 enables an operator to take actions in response to the information displayed.

Figure 2A:
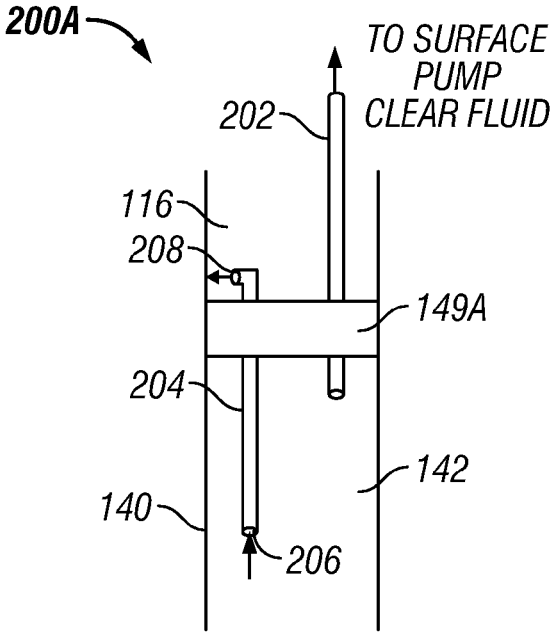
FIG. 2A is a schematic diagram of a section of the wellbore showing an apparatus for displacing wellbore fluid from a selected section of the wellbore with a laser-compatible medium.

FIG. 2A shows a schematic diagram of an embodiment of a system 200A for displacing the wellbore fluid 116 with a laser-compatible fluid 140 below the packer 149A. In the embodiment of FIG. 2A, a fluid line 202 is run from a surface unit that supplies a laser-compatible fluid to the isolated area below the packer 149A. The fluid line 202 terminates below or downhole of the packer 149A. The fluid line 202 may be run inside the coiled tubing 122 (FIG. 1). A fluid discharge line 204 runs from a location in the isolated section 140 that is below the end of the fluid line 202 into the wellbore section above the packer 149A. When the replacement fluid 140, which is normally clear and lighter than the wellbore fluid (i.e. having a specific gravity lower than the wellbore fluid) is pumped into the zone 142, the heavier wellbore fluid 116 enters the bottom end 206 of the line 204 and discharges at its upper end 208 into the wellbore fluid 116 due to the upward pressure created by the laser-compatible fluid being pumped in. The laser-compatible fluid is pumped into the section 142 until substantially the entire section 42 is filled with the laser-compatible fluid 142.

Figure 2B:
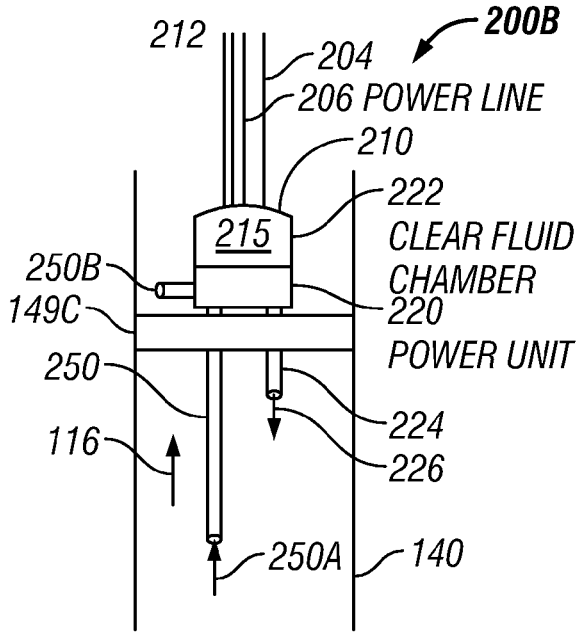
FIG. 2B is a schematic diagram of a section of a wellbore showing an alternative apparatus for displacing wellbore fluid from a selected wellbore section with a laser-compatible medium.

FIG. 2B shows a schematic diagram of a downhole system 200B for displacing the wellbore fluid 116 below the packer 149C with a laser-compatible fluid 140. In the configuration of FIG. 2B, a fluid injection unit 210 is conveyed into the wellbore by a tubing 204, which may be a coiled tubing, that carries a power line 206 and also may carry data or communication links 212. The fluid injection unit 210 includes a power unit 220, such as a pump driven by an electric motor that supplies under pressure laser-compatible fluid 226 contained in a fluid chamber 212 to the fluid line 224 that terminates below the packer 149C. The clear laser-compatible fluid 226, being lighter than the wellbore fluid 116, drives the wellbore fluid into the lower end 250A of the discharge line 250. The wellbore fluid from the isolated section 140 discharges via the outlet 250*b* into the wellbore above the packer 149C. The discharge line 250 may be routed through the fluid injection unit 210, in the manner shown in FIG. 2A or outside the unit 210, such as in the manner shown in FIG. 2A or in any other suitable manner. The fluid injection unit 210 may be used to displace the wellbore fluid and retrieved from the wellbore before deploying the laser unit or it may be deployed in conjunction or alongside the downhole laser unit 137 using a same or different carrier so that both such units can be conveyed and/or retrieved during a single trip into or out of the wellbore.

Figure 3:
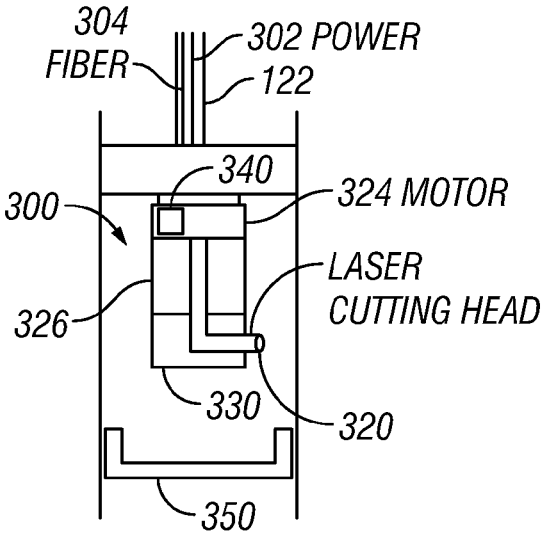
FIG. 3 shows a schematic diagram of an exemplary embodiment of certain features of the downhole laser section for performing an operation at a selected wellbore location or an object.

FIG. 3 is a schematic diagram showing certain features of the downhole laser unit 300 according to one embodiment of the disclosure. The downhole laser unit 300 is shown conveyed by the coiled tubing 122 that carries a power line 302 for supplying power to the laser unit 300 and one or more optical fibers 304 for supplying laser light from the surface laser unit 128 (FIG. 1) to the laser head 320 or tip carried by the downhole laser unit 300. The laser unit 300, in one aspect, includes a motor 324 that can orient the laser head 320 in any radial direction. The motor 324 along with a complimentary telescopic unit 326 or any other suitable unit can move the laser head 320 along the wellbore axis (i.e., axially along the wellbore direction). The same or a separate motor may be utilized to move the laser head 320 in the axial direction and the radial direction. A protective housing 330 may be provided to enclose the laser head 320. The housing 330 is opened to expose the laser head 320 to the location or the object at which the laser operation is to be performed after the wellbore fluid has been displaced with a laser-compatible medium. The downhole laser unit 300 also may include a controller 340 and associated memory and electrical circuitry that may be programmed to operate the laser head according to programmed instructions stored in the memory associated with a controller 340 or supplied during operation by the surface controller 160 (FIG. 1). The downhole laser unit 300 thus can orient the laser head 320 in any desired direction to perform the laser operation.

FIG. 4 shows a schematic diagram of another embodiment for deploying the downhole laser unit at a selected downhole location. In this embodiment, a flexible member, such as a sac or an inflatable packer 450 containing a laser-compatible medium is placed against or juxtaposed the area or object 443A at which the laser operation is to be performed. The flexible member 450 when placed against the object displaces the wellbore fluid 116 proximate the object. The size and shape of the flexible member 450 is chosen based on the intended work area and the shape of the object. The flexible member 450 may be filled with the laser-compatible medium by pumping such a medium into the flexible member downhole by any suitable mechanism, such as a pump that pumps fluid from a chamber in the manner shown in FIG. 2B or from the surface via a line. The downhole laser unit includes a laser head 431 that may be placed against the flexible member 450 as shown in FIG. 4 or within the flexible member 450. The laser head 531 may be operated in a manner similar to the laser head 320 of FIG. 3. As an example, the laser head 431 is shown cutting a window in the casing 443 at the location 443A. The laser may cut the window according to preset contour in the memory of the downhole laser unit or such instructions may be provided from the surface laser unit 128 (FIG. 1). A laser cutting profile or tracer also may be used to cut the casing, wherein the tracer traces the predefined shape and the laser makes a corresponding cut. The other operations as noted above also may be performed including cutting rocks behind the casing.

Figure 5:
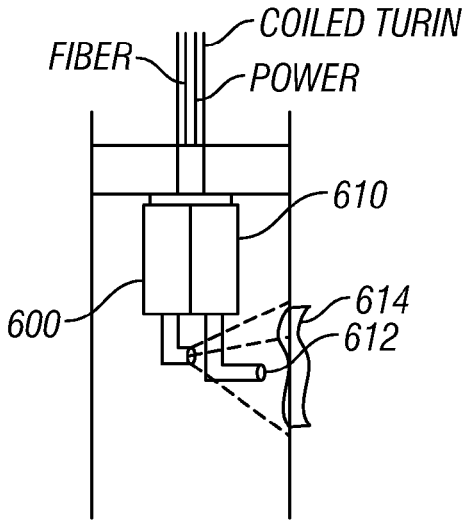
FIG. 5 shows a schematic diagram of a laser and an imaging device placed proximate a selected location in the wellbore for performing a laser operation in the wellbore and for imaging the wellbore section and the laser operation.

In some downhole laser applications, it is desirable to obtain visual or video images of the downhole work site or the object or the work or operation being performed. FIG. 5 shows a schematic diagram of the downhole laser unit 610 and an image device 600 deployed in a wellbore, wherein the image device 600 provides visual images of the work site and the operations performed by the laser unit 610. In one embodiment, the image device 600 may be a downhole video camera that exposes the object or the work area 614 to visual light and sends to the surface controller 160 (FIG. 1) live video pictures of the work area 614. In another embodiment, the image device 600 may be an acoustic or ultra sonic device that sends visual images to the surface or data from which images can be derived for display by the surface controller 160. It is feasible to use video cameras because the laser-compatible medium is sufficiently clear so as to allow the camera 600 to take live pictures.

The image device 660 may be operated to send visual images of the downhole work area and the actual laser work being performed downhole, which enables an operator to make any desired adjustments with respect to the operation of the laser head 612 and the intensity of the laser beam. In any of the embodiments made according to the concepts disclosed herein, a laser-compatible medium is used to displace at least a portion of the fluid at or proximate a work site or the object. The laser head is then positioned proximate the work site in a manner that the laser beam can impinge onto the object through the laser-compatible medium. The laser is then activated for the surface by the controller 160 to supply a desired amount of the laser energy, which may differ from a job to job. The light energy supplied from the surface laser source 128 passes through the fiber 122 to the laser head and onto the selected object. The controller 160 at the surface may use programmed instructions to control the energy level and the movement of the laser head so that the laser energy impinges on the desired area in the desired amount and for a desired time period. By controlling the movement of the laser head and the energy level (laser intensity) a variety of different operations may be performed. Visual images may be obtained and utilized to control the operation of the laser head. The laser may be utilized to perform a cutting operation, such a cutting a section of a casing 443A (FIG. 4) or another element downhole, including a section of a formation. The laser may be used to disintegrate an object (metal or rock etc.) into any size, including relatively small pieces that if left in the wellbore will not be detrimental to future operations of the well or the equipment therein. Alternatively, the object may be vaporized. In other aspects, the laser may be used to apply localized heat to bond a member or material on to another member or material. The laser may be used to activate a heat sensitive material, such as a polymer or a chemical agent, or to remove waxes, build scale, cut a material, vaporize a material or to perform a welding operation. An inflatable or a flexible member may be used to carry and/or place a member to be welded or bonded onto another member downhole. The laser is then used to bond or weld one member onto another.

In another aspect, a catcher, such as a retrievable catcher 350 (FIG. 3) may be used to collect the debris created by the laser operations, such as cutting of pipe sections, rocks or cuttings of stuck objects, such as drilling and production equipment.

While the foregoing disclosure is directed to certain embodiments that may include certain specific elements, such embodiments and elements are shown as examples and various modifications thereto apparent to those skilled in the art may be made without departing from the concepts described and claimed herein. It is intended that all variations within the scope of the appended claims be embraced by the foregoing disclosure.

What is claimed is:

1. A method for performing a laser operation in a wellbore, comprising:

isolating a selected location in the wellbore;

displacing a fluid in the wellbore using a laser-compatible medium, the fluid being displaced from the isolated location in the wellbore to another location in the wellbore;

positioning a laser head proximate the laser-compatible medium;

passing a laser beam from the laser head via the laser-compatible medium to perform the laser operation;

actuating a first and a second isolation member to isolate the selected location;

and displacing the fluid after actuating the first and the second isolation member;

isolating the fluid using the first and the second isolation members before displacing the fluid in the wellbore with the laser-compatible medium; and displacing the isolated fluid using a discharge line that has an end that discharges into the wellbore.

2. The method of claim 1 further comprising supplying the laser beam to the laser head using one of (i) an optical fiber that runs from a laser source at a surface location to the laser head; and (ii) a laser source disposed in the wellbore.

3. The method of claim 1, wherein the laser-compatible medium is one of a: (i) liquid; (ii) gas; (iii) gel; (iv) a combination of at least two of a liquid, gas and gel; (v) polymer material; (vi) lens; (vii) transparent membrane; and (viii) membrane filled with a transparent material; and (ix) an inflatable member that comprises a laser-compatible medium.

4. The method of claim 1 further comprising displacing the wellbore fluid by pumping the laser-compatible medium using a pump in the wellbore; and pumping the laser-compatible medium from a container conveyed into the wellbore.

5. The method of claim 1 further comprising imaging the selected location.

6. The method of claim 5, wherein imaging the selected location includes one of (i) imaging the selected location while the laser operation is being performed at the selected location; (ii) imaging the selected location by using a video camera; and (iii) imaging the selected location by using an acoustic device.

7. The method of claim 1, wherein the laser operation is selected from a group consisting of: (i) a cutting operation; (ii) a welding operation; (iii) activating a polymer; (iv) activating a chemical; (v) activating a heat sensitive material in the wellbore; (vi) activating a memory metal; (vii) removing a wax; (viii) applying localized heat to heat bond a material; and (ix) a bonding operation.

8. The method of claim 1 further comprising collecting at least some debris produced by the laser operation.

9. The method of claim 1 further comprising conveying the laser head into the wellbore by a tubing carrying an optical fiber that provides light energy from a surface light source to the laser head.

10. The method of claim 1, wherein performing the laser operation includes controllably impinging the laser beam on to an object at the selected location using one of: (i) a controller at the surface that controls the laser beam; (ii) a controller proximate the laser beam; and (iii) control signals sent to the laser head in response to an image of the location.

11. The laser apparatus of claim 1, wherein the laser-compatible medium is selected from one of: (i) a fluid lighter than the fluid being displaced, and (ii) a fluid clearer than the fluid being displaced.

12. The laser apparatus of claim 1, wherein the laser-compatible medium is selected from one of: (i) a fluid lighter than the fluid being displaced, and (ii) a fluid clearer than the fluid being displaced.

13. A laser apparatus for performing a laser operation at a worksite in a wellbore having a fluid, comprising:

a laser power unit configured to supply laser energy to a laser head placed proximate the worksite having a casing;

a fluid displacement unit configured to displace at least a portion of the fluid adjacent the worksite to another location that is isolated from the worksite in the wellbore using a laser-compatible medium; and a controller configured to operate a laser beam at the worksite through the laser-compatible medium; and an isolation member configured to isolate the worksite; and a discharge line configured to convey the fluid from the isolated worksite.

14. A laser apparatus for performing a laser operation at a worksite in a wellbore having a fluid, comprising:

a laser power unit configured to supply laser energy to a laser head placed proximate the worksite, the work site having a casing;

a fluid displacement unit configured to displace at least a portion of the fluid adjacent the worksite to another location in the wellbore that is isolated from the worksite in the wellbore using a laser-compatible medium;

a controller configured to operate a laser beam at the worksite through the laser-compatible medium; and a first and a second isolation member configured to isolate the selected location, wherein the fluid displacement unit is configured to displace the fluid out of the selected location after the first and the second isolation member are actuated, the selected location being in the casing.

15. The laser apparatus of claim 14, wherein the laser power unit is placed at a surface location and the laser head is proximate the worksite in a wellbore and wherein the laser beam is supplied to the laser head via optical fibers that run from the surface to a downhole location within a tubing.

16. The laser apparatus of claim 14, wherein the fluid displacement unit is configured to supply the laser-compatible medium using one of: a pump in the wellbore; a fluid chamber containing the laser-compatible medium deployed downhole.

17. The laser apparatus of claim 16, wherein the laser-compatible medium comprises at least one of: (i) a substantially clear fluid; (ii) a flexible member that abuts against an object; (iii) an inflatable member that has a laser-compatible medium; (iv) a lens; (v) a polymer; (vi) a liquid; (vii) a gas; (viii) a gel; and (ix) a combination of at least two of a gas, liquid and gel.

18. The laser apparatus of claim 14, wherein the controller is configured to operate the laser in response to one of: (i) a contour stored in a memory; (ii) a feedback signal; and (iii) an image of the worksite.

19. The laser apparatus of claim 14 further comprising an imager configured to provide visual images of a selected location downhole.

20. The laser apparatus of claim 19, wherein the imager is one of: (i) a video camera; (ii) an acoustic imager that sends an image to the surface; and (iii) an acoustic imager that sends data from which a surface controller derives an image.

21. The laser apparatus of claim 14, wherein the laser operation performed by the apparatus is selected from a group consisting of: (i) a cutting operation; (ii) a welding; (iii) activating a polymer; (iv) activating a chemical; (v) activating a heat sensitive material in the wellbore; (vi) activating a memory metal; (vii) removing a wax; (viii) applying localized heat to heat bond a material; and (ix) bonding operation.

22. The laser apparatus of claim 14 further comprising a catcher configured to collect downhole at least a portion of a material disintegrated by the laser beam.

23. The laser apparatus of claim 14, wherein the laser head is configured to be conveyed into the wellbore by a tubular member that carries a power line and a data communications link.

24. The laser apparatus of claim 13, wherein the discharge line has lower end below the isolation member and an outlet in the wellbore.

25. The laser apparatus of claim 13, wherein the discharge laser-compatible medium is more transparent than the fluid being displaced.

* * * * *